US005329706A

United States Patent [19]

Pozzobon

[11] Patent Number: 5,329,706

[45] Date of Patent: Jul. 19, 1994

[54] COMPOSITE SKI BOOT QUARTER

[75] Inventor: Alessandro Pozzobon, Paderno di Ponzano Veneto, Italy

[73] Assignee: Nordica S.p.A., Montebelluna, Italy

[21] Appl. No.: 843,039

[22] Filed: Feb. 28, 1992

Related U.S. Application Data

[63] Continuation-in-part of Ser. No. 592,935, Oct. 4, 1990, Pat. No. 5,101,582.

[30] Foreign Application Priority Data

Oct. 20, 1989 [IT] Italy ..... 82596 A/89

[51] Int. Cl.[5] ..... A43B 5/04

[52] U.S. Cl. ..... 36/117; 36/118

[58] Field of Search ..... 36/117, 118, 119, 120, 36/121

[56] References Cited

U.S. PATENT DOCUMENTS

| | | | |
|---|---|---|---|
| 3,803,730 | 4/1974 | Hanson et al. | 36/117 |
| 3,939,582 | 2/1976 | Garbuio | 36/117 |
| 4,179,827 | 12/1979 | Vaccari | 36/119 |
| 4,184,273 | 1/1980 | Boyer et al. | 36/117 X |
| 4,280,286 | 7/1981 | Sartor | 36/118 |
| 4,510,703 | 4/1985 | Eiteljorg | 36/117 X |
| 4,587,747 | 5/1986 | Courvoisier et al. | 36/117 |
| 5,079,858 | 1/1992 | Sartor et al. | 36/117 |
| 5,101,582 | 4/1992 | Pozzobon | 36/117 |

FOREIGN PATENT DOCUMENTS

| | | |
|---|---|---|
| 0015862 | 9/1980 | European Pat. Off. . |
| 0071055 | 2/1983 | European Pat. Off. . |
| 424769 | 5/1991 | European Pat. Off. . |
| 2310717 | 12/1976 | France . |
| 1427640 | 3/1976 | United Kingdom . |

*Primary Examiner*—Paul T. Sewell
*Assistant Examiner*—BethAnne Cicconi
*Attorney, Agent, or Firm*—Guido Modiano; Albert Josif; Daniel O'Byrne

[57] ABSTRACT

The composite ski boot quarter includes a pair of oppositely arranged lateral malleolus supporting elements, a rear calf supporting element, and a front tibial supporting element rigidly interconnected to form the quarter. The lateral supporting elements are made of generally rigid material to provide excellent force transmission during skiing and the rear calf and front tibial supporting elements are made of less rigid material to provide improved comfort.

11 Claims, 5 Drawing Sheets

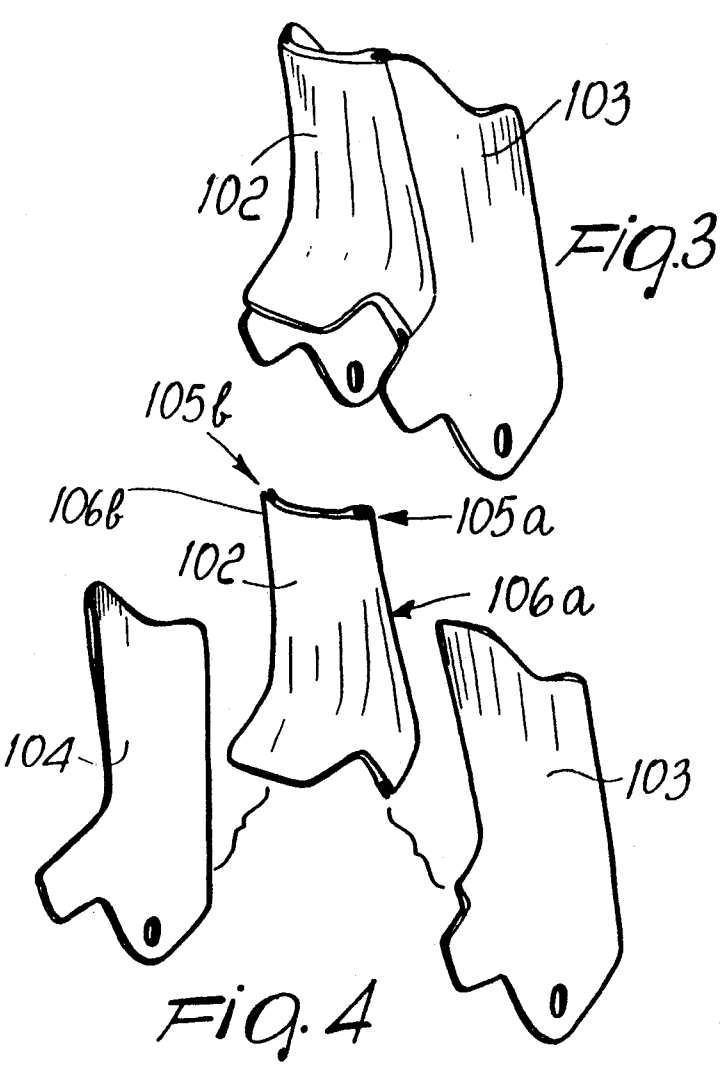
Fig.3
Fig.4
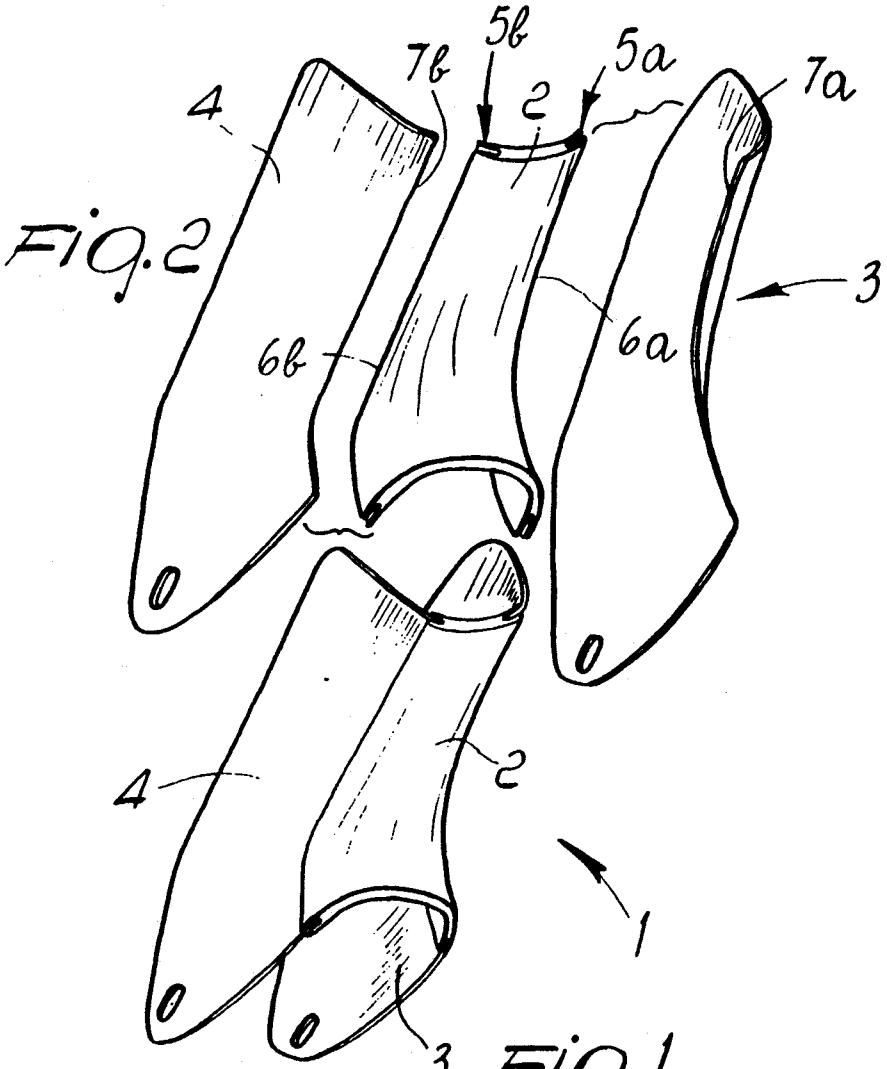
Fig.2
Fig.1

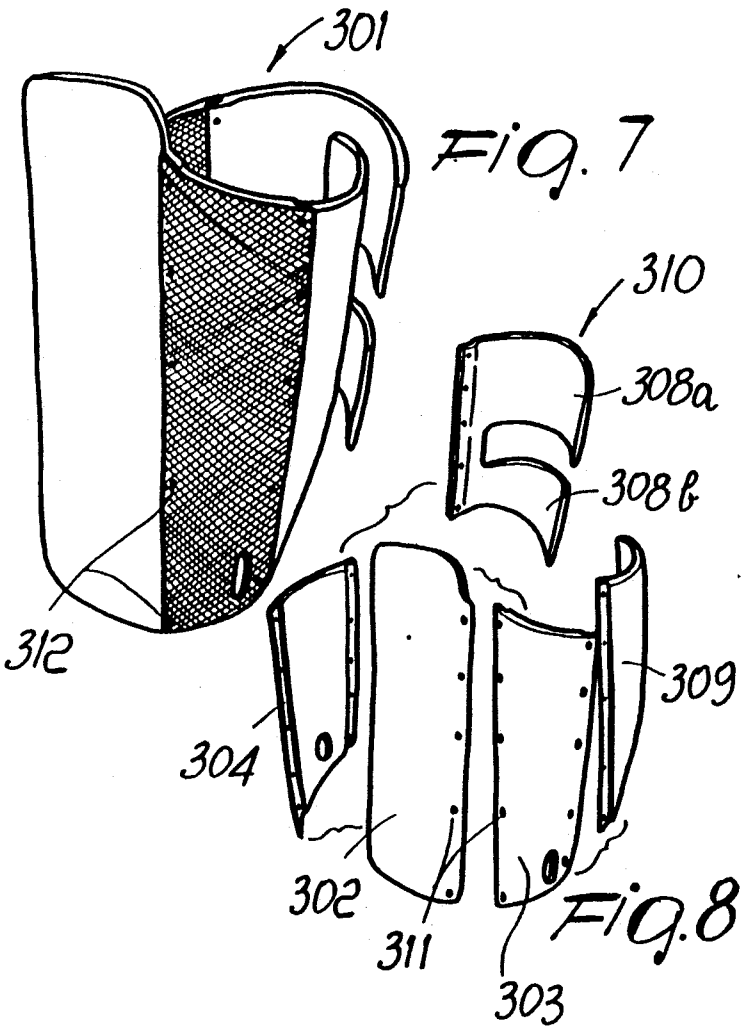
Fig. 7
Fig. 8
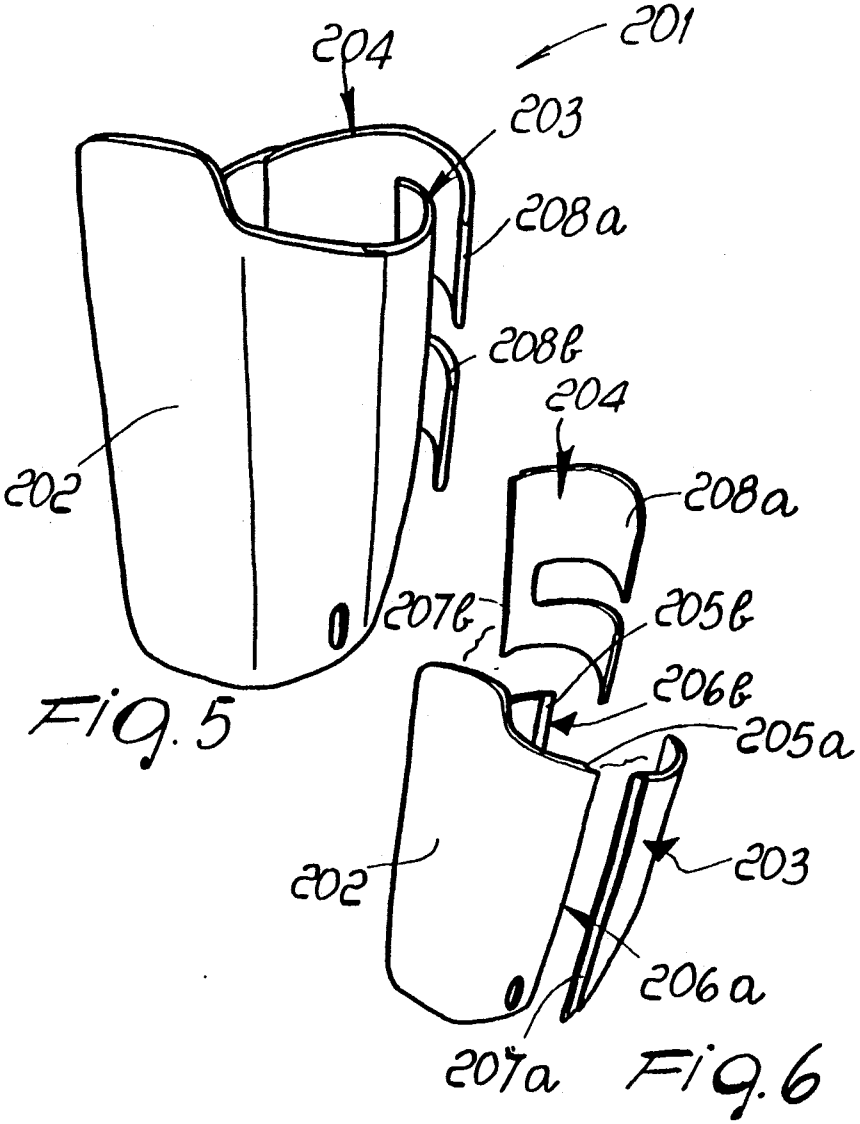
Fig. 5
Fig. 6

COMPOSITE SKI BOOT QUARTER

RELATED U.S. APPLICATIONS

This is a continuation-in-part of application Ser. No. 07/592,935 filed Oct. 4, 1990, now U.S. Pat. No. 5,101,582, issued Apr. 7, 1992.

BACKGROUND OF THE INVENTION

The present invention relates to a composite ski boot quarter.

Currently, the quarters of the known ski boots, both of the rear-entry type and of the front-entry type, are made by injection-molding of thermoplastic material, said quarters being usually produced monolithically.

This manufacturing process entails some disadvantages, since the use of thermoplastic materials does not meet the various requirements of the skier while skiing, as the quarter or quarters must have at the same time a given flexibility for a comfortable support of the tibia and lateral rigidity for the optimum transmission of efforts to the ski.

As a partial solution to these disadvantages, a rear-entry ski boot is known wherein the front quarter is formed by two elements which are divided along a longitudinal axis and are composed of materials which have different rigidity.

Even this solution, however, has disadvantages, since the two elements are fastened at the longitudinal axis by means of an adapted slider, and therefore with an additional device, and it has furthermore been observed that during skiing the two elements undergo different deformations at the tibial support region.

This entails an uneven support of the tibia itself and a different yielding of the two elements during flexing, causing a troublesome and difficult control of the ski.

SUMMARY OF THE INVENTION

The aim of the present invention is therefore to eliminate the disadvantages described above in known types by providing a quarter which has flexibility and/or rigidity characteristics at the required points of the skier's leg.

Within the scope of the above described aim, another important object is to provide a quarter which allows to achieve an optimum and uniform support for the tibia.

Still another important object is to provide a quarter which has uniform yielding.

Another object is to provide a quarter which allows the optimum transmission of efforts to the ski.

Another object is to provide a quarter which is reliable and safe in use.

Not least object is to provide a quarter which has modest production costs and can be easily industrialized.

This aim, these objects and others which will become apparent hereinafter are achieved by a composite ski boot quarter which includes a first lateral malleolus supporting element and a second supporting element which is rigidly connected to the first element and which is a front tibial region supporting element or a rear calf region supporting element, and the first supporting element has a higher degree of rigidity than the second supporting element. Advantageously, two rigid lateral malleolus supporting elements and both a front tibial supporting element and rear calf supporting element of less rigidity are combined to form the ski boot quarter.

BRIEF DESCRIPTION OF THE DRAWINGS

Further characteristics and advantages of the invention will become apparent from the description of some particular but not exclusive embodiments, illustrated only by way of non-limitative example in the accompanying drawings, wherein:

FIG. 1 is an isometric view of an assembled composite front quarter according to the invention;

FIG. 2 is an isometric exploded view of the quarter of the preceding figure, showing the individual elements which compose it;

FIG. 3 is a view, similar to that of FIG. 1, of an assembled composite quarter according to a second aspect of the invention;

FIG. 4 is an isometric exploded view, similar to that of FIG. 2, of the components of the quarter of FIG. 3;

FIG. 5 is a view, similar to that of FIG. 1, of a composite quarter according to a third aspect of the invention;

FIG. 6 is an isometric exploded view of the quarter of FIG. 5;

FIG. 7 is a view, similar to that of FIG. 1, of a composite quarter according to a fourth aspect of the invention;

FIG. 8 is an isometric exploded view, showing the components of the quarter of FIG. 7;

DESCRIPTION OF THE PREFERRED EMBODIMENTS

Figure 10:
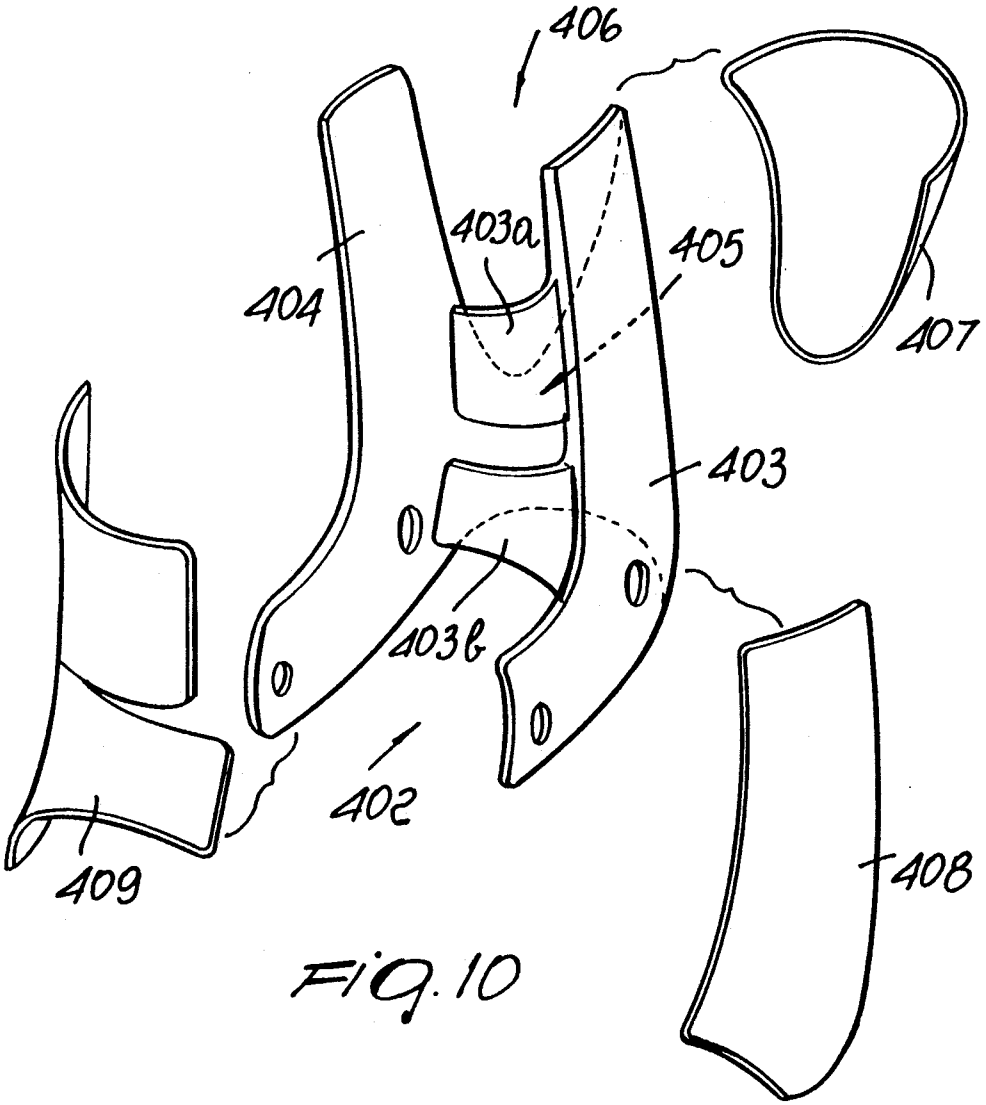
FIG. 10 is an isometric exploded view, showing the components of the quarter of FIG. 9.

With particular reference to FIGS. 1 and 2, the reference numeral 1 indicates a composite quarter according to the present invention, particularly for rear-entry ski boots, which comprises a first element 2 which affects the front region of the tibia and embraces it approximately up to the foot instep.

The quarter 1 furthermore comprises a second element 3 and a third element 4 which affect the lateral regions of the leg of the skier, including therefore the tibia and the malleoli, and are associable at the first element 2.

The various elements are fastened together for example by welding, gluing, restraint jointing, riveting or by other known means.

In the particular embodiment illustrated in FIGS. 1 and 2, the means for the mutual assembly of the first, second and third elements are constituted by a pair of grooves 5*a* and 5*b* which are defined longitudinally at the lateral perimetric edges 6*a* and 6*b* of the first element 2.

Said pair of grooves 5*a* and 5*b* constitutes a seat in the restraint joint of the complimentarily shaped perimetric edge 7*a* and 7*b* respectively of the second element 3 and of the third element 4.

For a more secure fastening the elements may also be glued together at the restraint joint.

By providing the quarter in three elements, it is possible to obtain diverse chromatic combinations and, most of all, a differentiation of the materials which compose the quarter structure itself, so that, for example, it is possible to have a first element 2, frontal with respect to the tibia, which is relatively yielding so as to have flexibility and a comfortable support for the tibia itself, whereas the lateral elements 2 and 3 can have a rigidity adapted to correctly transmit the efforts to the ski.

The individual elements can furthermore be obtained with a minimum curvature and therefore even with manufacturing processes other than the injection molding, thus adopting composite materials.

It has thus been observed that the invention has achieved the intended aim and objects, a quarter having been obtained which has characteristics of flexibility and/or rigidity at the required points of the skier's leg, providing an optimum and uniform support for the tibia and at the same time good lateral rigidity for the optimum transmission of efforts to the ski.

The individual components of the quarter can furthermore be produced according to processes differing from those of the injection of thermoplastic material and can be obtained for example by means of composite materials, the degree of rigidity whereof can be selected according to the specific requirements.

The quarter according to the invention is naturally susceptible to numerous modifications and variations, all of which are within the scope of the same inventive concept.

Thus, for example, as illustrated in FIGS. 3 and 4, the pair of grooves 105*a* and 105*b* defined at the perimetric edges 106*a* and 106*b* of the first element 102 can be obtained at an enlargement of the thickness defined at said perimetric edges, and the second element 103 and the third element 104 can also have various configurations according to the specific requirements, similarly to the first element 102.

FIGS. 5 and 6 illustrate a quarter for front-entry ski boots, indicated by the numeral 201, which is again constituted by a first element 202, by a second element 203 and by a third element 204.

The first element 202 can affect both the region behind the tibial region and, partially, the lateral regions thereof, and said structure can be made of a rigid material.

Longitudinal recesses 205*a* and 205*b* are defined at the lateral perimetric edges 206*a* and 206*b*, and a complimentarily shaped end, defined at the perimetric edges 207*a* of the second element 203 and 207*b* of the third element 204, can be arranged thereat.

Advantageously, the second and third elements are made of a resilient material, and the element 204 has a pair of flaps 208*a* and 208*b* which partially embrace the outer lateral surface of the second element 203.

Adapted means, such as levers, suitable for further securing the elements to one another, may be applied at said flaps.

Said elements may also naturally be fastened together by means of adapted adhesives or by welding or riveting.

FIGS. 7 and 8 illustrate another embodiment of a quarter 301 for front-entry ski boots, comprising: a first element 302, which affects the rear region of the calf; a second element 303, which partially and laterally embraces the leg; a third element 304, which also partially and laterally embraces the leg; a fourth element 309, which is associated with said second element and partially and frontally embraces the leg; and a fifth element 310, which is associated with said third element 304 and has a pair of flaps 308*a* and 308*b* which partially embrace the outer surface of the fourth element 309.

Advantageously, all of said first, second, third, fourth and fifth elements can be fastened together by means of an adapted riveting or by screwing or gluing or welding, the second and the third elements being advantageously made, for example, of composite materials with high rigidity.

The fourth and fifth element can instead be made of a material which has a certain resiliency so as to increase the comfort of the skier.

In the particular embodiment, the reference numerals 311 indicate holes which are defined at the perimetric edges of the first, second, third, fourth and fifth elements, and constitute seats for adapted mutual locking rivets 312.

The materials, as well as the dimensions, which constitute the individual components of the structure may naturally also be the most appropriate according to the specific requirements.

Figure 9:
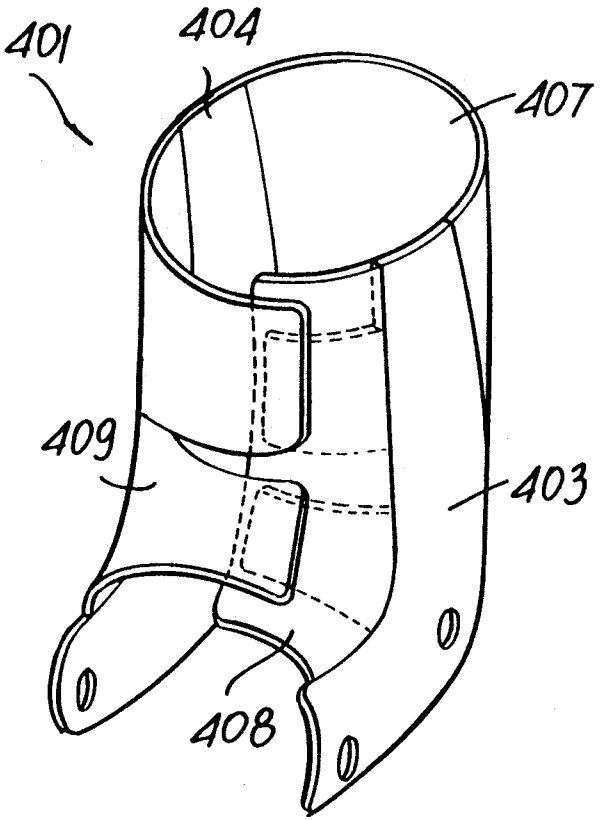
FIG. 9 is a perspective view of a composite ski boot quarter according to a fifth aspect of the invention.

FIGS. 9 and 10 show a ski boot composite quarter 401 according to a further aspect of the present invention. Such composite quarter 401, particularly for a left-footed boot, includes a monolithic supporting framelike element 402 which has a lateral malleolus supporting region 403 and a medial malleolus supporting region 404 mutually interconnected by a lower bridge region 405 overlying the user's heel region. The monolithic framelike element 402 is thus provided with a substantially V-shaped gap 406 at the user's calf region above the lower bridge region 405, and a similarly V-shaped rear calf supporting element 407 is rigidly attached to the monolithic framelike element 402 along the perimetric edge defined by the V-shaped gap 406. The composite quarter 401 furthermore includes a first front tibial supporting element 408 and a second front tibial supporting element 409 rigidly connected respectively to the lateral malleolus supporting region 403 and the medial malleolus supporting region 404. The second front tibial supporting element 409 is provided with flap elements for overlapping and connection to the first front tibial supporting element 408. The first lateral malleolus supporting region 403 is furthermore provided with a pair of flap elements 403*a* and 403*b* which are arranged and extend below the first front tibial supporting element 408. Advantageously, the malleolus supporting regions 403 and 404 are made of a rigid material while the front tibial supporting elements 408 and 409 are made of compliant material and the rear calf supporting element 407 is provided in either compliant material or a stiffer semirigid material. The composite quarter 401 structured in this manner thereby provides an excellent customized support in which the stiff lateral regions thereof facilitate the transmission of lateral forces from the user directly to the ski, while the relatively yielding front tibial and rear calf portions provide a comfortable support.

Figure 12:
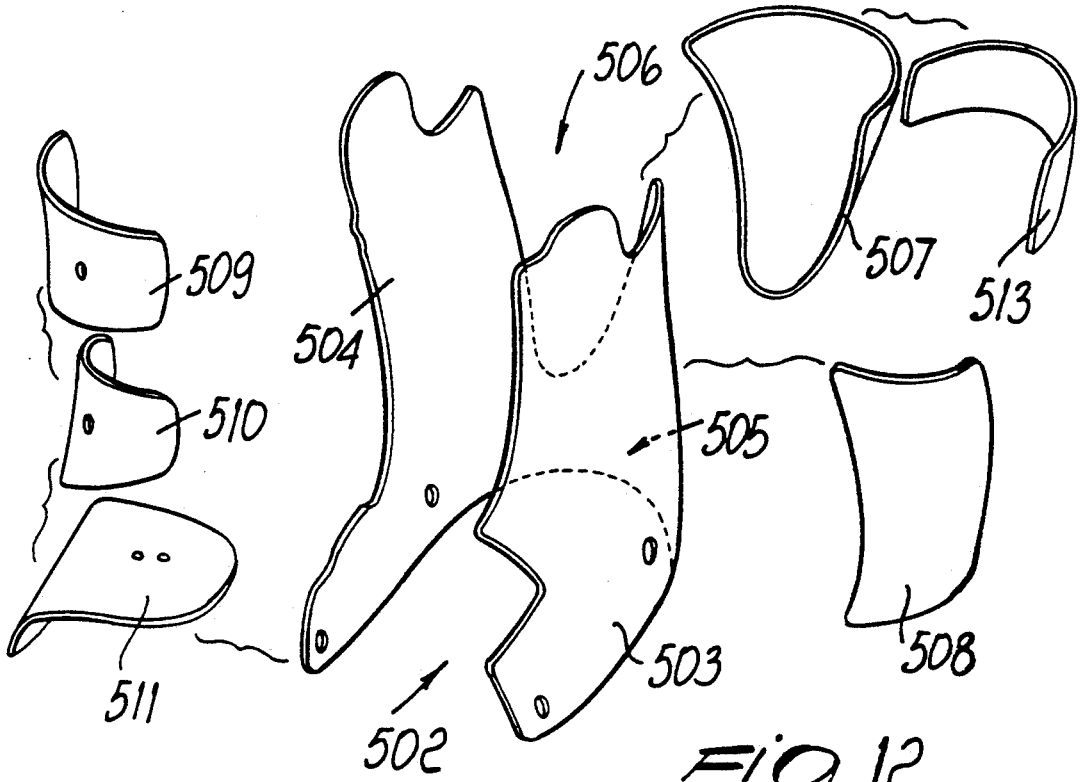
FIG. 12 is an isometric exploded view, showing the components of the quarter of FIG. 11.
Figure 11:
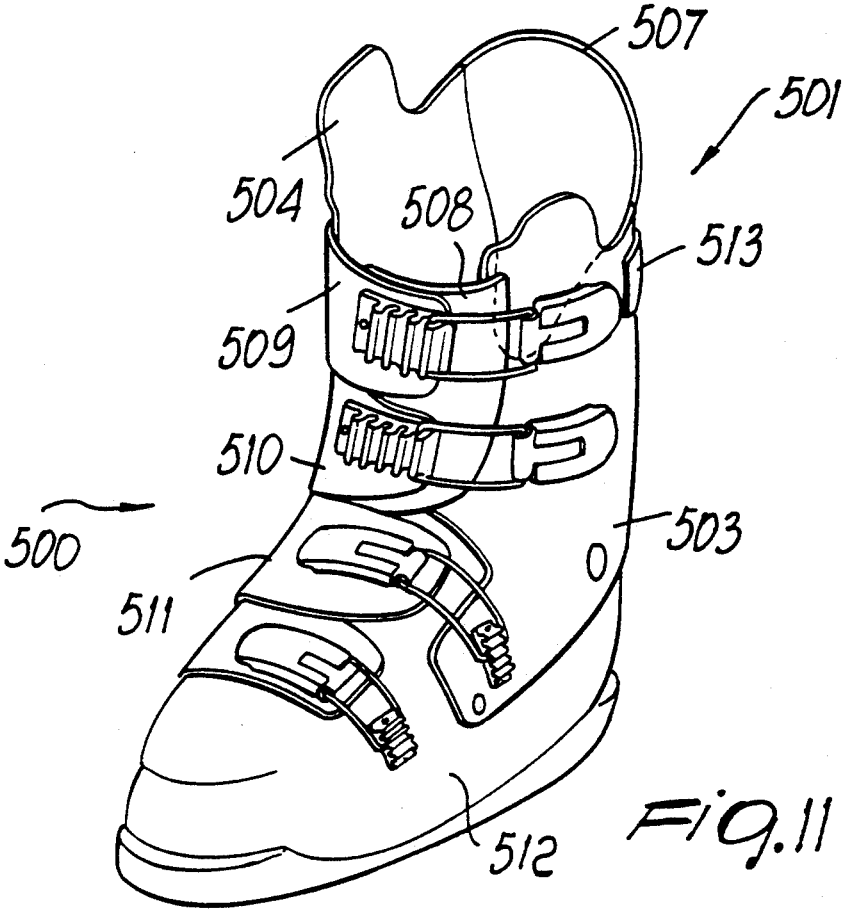
FIG. 11 is a perspective view of a ski boot provided with a composite quarter according to a sixth aspect of the invention.

FIG. 11 shows a ski boot 500 provided with a composite ski boot quarter 501 according to a further aspect of the present invention. The quarter 501, particularly for a left-footed boot, includes (FIG. 12), similarly to the quarter 401 as described above, a monolithic supporting framelike element 502 having a lateral malleolus supporting region 503 and a medial malleolus supporting region 504 mutually interconnected by a lower bridge region 505 overlying the user's heel region, and a substantially V-shaped gap 506 at the user's calf region above the lower bridge region 505. A similarly V-shaped rear calf supporting element 507 is rigidly attached to the monolithic framelike element 502 along the perimetric edge defined by the V-shaped gap 506. The composite quarter 501 furthermore includes a first front tibial supporting element 508 rigidly connected to the lateral malleolus supporting region 503, and an upper pair of flap front tibial supporting elements 509 and 510 connected to the medial malleolus supporting region 504 and overlapping the first front tibial supporting element 508, and a lower flap supporting element 511 which overlaps the ski boot shell 512 and which is connected to the lateral malleolus supporting region 503. A rear strap-like element 513 which extends across the rear calf supporting element 507 and which is connected between the lateral 503 and medial 504 malleolus supporting regions is also provided for extra comfort support. In order to provide excellent supporting characteristics which allow proper force transmissions while maintaining maximum comfort, the malleolus supporting regions 503 and 504 are made of a rigid material while the front tibial supporting elements 508-511 are made of compliant material and the rear calf supporting element 507 and strap-like element 513 are provided in either compliant material or a stiffer semirigid material.

Figure 14:
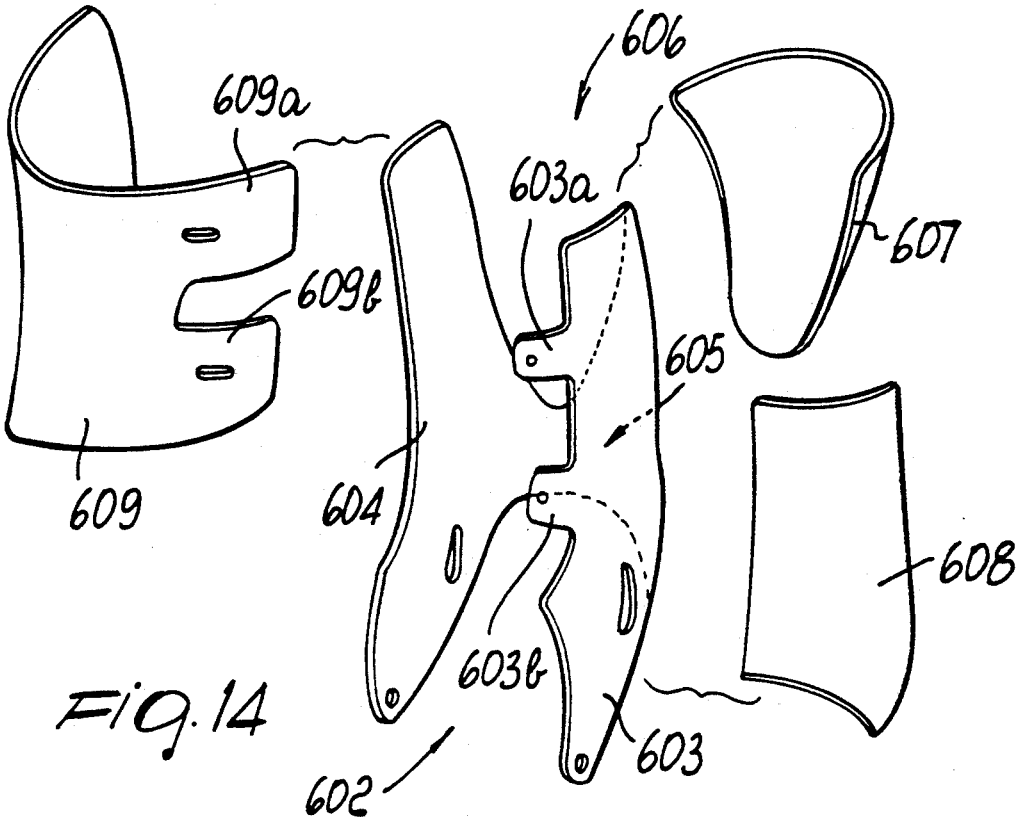
FIG. 14 is an isometric exploded view, showing the components of the quarter of FIG. 13.
Figure 13:
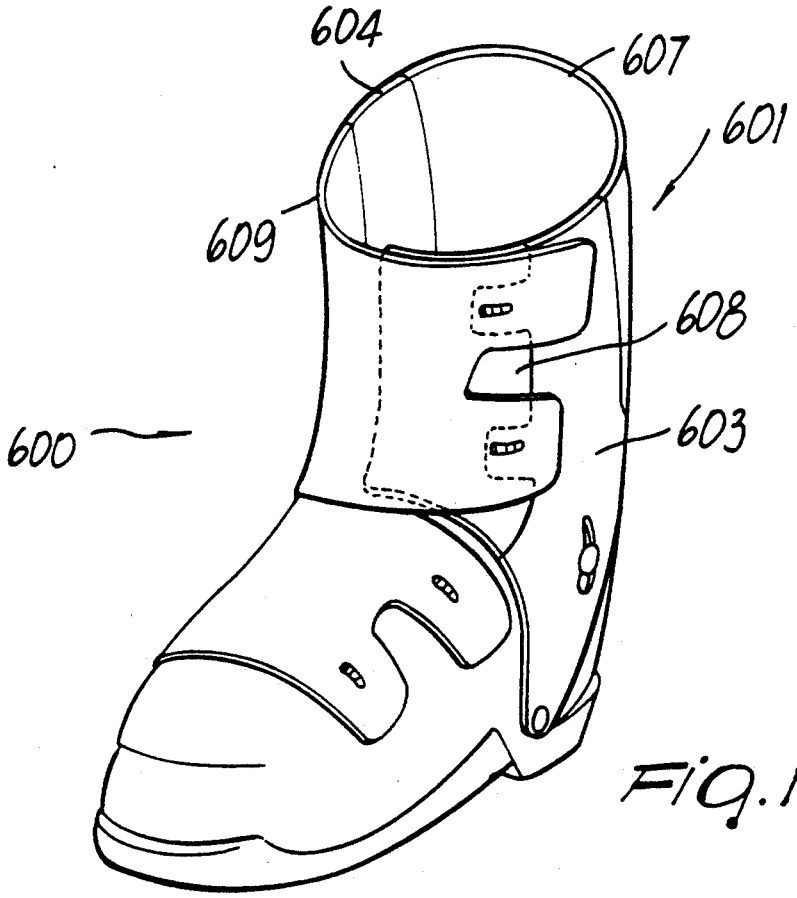
FIG. 13 is a perspective view of a ski boot provided with a composite quarter according to a seventh aspect of the invention.

FIG. 13 shows in particular a left-footed ski boot 600 which is provided with a composite quarter 601 according to another aspect of the present invention. Such quarter 601 (FIG. 14) also has a monolithic supporting framelike element 602 comprising a lateral malleolus supporting region 603 and a medial malleolus supporting region 604 which are arranged mutually opposite and which are interconnected by a lower bridge region 605 overlying the user's heel region. The supporting framelike element 602 has a substantially V-shaped gap 606 at the user's calf region above the lower bridge region 605 which defines a perimetric edge to which is connected a similarly shaped rear calf supporting element 607. A first front tibial supporting element 608 is rigidly connected to the lateral malleolus supporting region 603 and a second front tibial supporting element 609 is rigidly connected to the medial malleolus supporting region 604. The second front tibial supporting element 609 is provided with flap elements **609*a* and 609*b* for overlapping the first front tibial supporting element 608 and for being connectable to respective tab elements 603*a* and 603*b* of the lateral malleolus supporting region 603. The malleolus supporting regions 603 and 604 are made of a rigid material while the front tibial supporting elements 608 and 609 are made of compliant material and the rear calf supporting element 607** is provided in either compliant material or a stiffer semi-rigid material, so as to advantageously provide improved support.

I claim:

1. A composite ski boot quarter, comprising:

a first supporting element, said first supporting element being a malleolus supporting element for supporting at least a malleolus region of a user's lower leg, said first supporting element having at least a first perimetric edge; and a second supporting element for supporting a front tibial region of a user's lower leg, said second supporting element having at least a second perimetric edge;

wherein said first supporting element and said second supporting element are rigidly mutually connected along said first perimetric edge and said second perimetric edge thereof, and wherein said first supporting element has a higher degree of rigidity than said second supporting element.

2. Composite ski boot quarter according to claim 1, wherein the quarter further comprises a third supporting element (4), said first ;supporting element (3) being a medial malleolus supporting element for supporting a medial malleolus region of a user's lower leg, said third supporting element being a lateral malleolus supporting element for supporting a lateral malleolus region of a user's leg, said third supporting element having a higher degree of rigidity than said second supporting element (2), said third supporting element having a third perimetric edge and said second supporting element having a fourth perimetric edge in addition to said second perimetric edge, said third supporting element and said second supporting element being rigidly mutually connected along said third perimetric edge and said fourth perimetric edge thereof.

3. Composite ski boot quarter according to claim 1, wherein said first supporting element (202) supports both a lateral malleolus region and a medial malleolus region and the rear calf region of a user's lower leg, said second supporting element comprising a first front tibial supporting element (203) and a second front tibial supporting element (204), said first perimetric edge (**206*a*) of said first supporting element being arranged at said lateral malleolus region and said first front tibial supporting element being provided with said second perimetric edge (207*a*), said first supporting element having a third perimetric edge (206*b*) which is arranged at said medial malleolus region opposite to said lateral malleolus region, said second front tibial supporting element having a fourth perimetric edge (207*b*), said first supporting element and said second front tibial supporting element being rigidly mutually connected along said third perimetric edge and said fourth perimetric edge thereof, said second front tibial supporting element being provided with a pair of flap elements (208*a* and 208*b***) for overlapping said first front tibial supporting element.

4. Composite ski boot quarter according to claim 1, wherein said first supporting element is a lateral malleolus supporting element (303) and said second supporting element is a first front tibial supporting element (309), said first supporting element having a third perimetric edge, the quarter further comprising:

a third rear calf supporting element (302), said third rear calf supporting element having a fourth perimetric edge and a fifth perimetric edge;

a medial malleolus supporting element (304), said medial malleolus supporting element having a sixth perimetric edge and a seventh perimetric edge; and a second front tibial supporting element (310), said second front tibial supporting element having an eighth perimetric edge, said first supporting element and said third rear calf supporting element being rigidly mutually connected along said third perimetric edge and said fourth perimetric edge thereof, said third rear calf supporting element and said medial malleolus supporting element being rigidly mutually connected along said fifth perimetric edge and said sixth perimetric edge thereof, said medial malleolus supporting element and said second front tibial supporting element being rigidly mutually connected along said seventh perimetric edge and said eighth perimetric edge thereof, said third rear calf supporting element and said second front tibial supporting element having a lower degree of rigidity than that of said lateral malleolus supporting element and said medial malleolus supporting element, said second front tibial supporting element being provided with a pair of flap elements (308*a* and 308*b*) for overlapping said first front tibial supporting element.

5. A composite ski boot quarter, comprising:

a first supporting element, said first supporting element being a malleolus supporting element for supporting at least a malleolus region of a user's lower leg, said first supporting element having at least a first perimetric edge; and a second supporting element for supporting a rear calf region of a user's lower leg, said second supporting element having at least a second perimetric edge;

wherein said first supporting element and said second supporting element are rigidly mutually connected along said first perimetric edge and said second perimetric edge thereof, and wherein said first supporting element has a higher degree of rigidity than said second supporting element.

6. Composite ski boot quarter according to claim 5, wherein the quarter further comprises a third supporting element (104), said first supporting element (103) being a lateral malleolus supporting element for supporting a lateral malleolus region of a user's lower leg, said third supporting element being a medial malleolus supporting element for supporting a medial malleolus region of a user's leg, said third supporting element having a higher degree of rigidity than said second supporting element, said third supporting element having a third perimetric edge and said second supporting element having a fourth perimetric edge in addition to said second perimetric edge, said third supporting element and said second supporting element being rigidly mutually connected along said third perimetric edge and said fourth perimetric edge thereof.

7. Composite ski boot quarter according to claim 5, wherein said first supporting element is a monolithic supporting framelike element (402) comprising a lateral malleolus supporting region (403) and a medial malleolus supporting region (404), said lateral malleolus supporting region and said medial malleolus supporting region being arranged mutually opposite and being interconnected by a lower bridge region (405) overlying the user's heel region, said monolithic framelike element being provided with a substantially V-shaped gap (406) at the user's calf region above said lower bridge region, said first perimetric edge defining said V-shaped gap, said second supporting element being a rear calf supporting element (407) having a shape substantially equivalent to said V-shaped gap, the quarter further comprising a first front tibial supporting element (408) and a second front tibial supporting element (409), said first front tibial supporting element being rigidly connected to said lateral malleolus supporting region and said second front tibial supporting element being rigidly connected to said medial malleolus supporting region, said first and second front tibial supporting elements having a lower degree of rigidity than said monolithic supporting framelike element, said second front tibial supporting element being provided with flap elements for overlapping said first front tibial supporting element.

8. Composite ski boot quarter according to claim 7, wherein said lateral malleolus supporting region is provided with a pair of flap elements (403*a* and 403*b*) which are arranged and extend below said first front tibial supporting element.

9. Composite ski boot quarter according to claim 5, wherein said first supporting element is a monolithic supporting framelike element (502) comprising a lateral malleolus supporting region (503) and a medial malleolus supporting region (504), said lateral malleolus supporting region and said medial malleolus supporting region being arranged mutually opposite and being interconnected by a lower bridge region (505) overlying the user's heel region, said monolithic framelike element being provided with a substantially V-shaped gap (506) at the user's calf region above said lower bridge region, said first perimetric edge defining said V-shaped gap, said second supporting element being a rear calf supporting element (507) having a shape substantially equivalent to said V-shaped gap, the quarter further comprising a first front tibial supporting element (508) and a plurality of individual flap-like front tibial supporting elements (509–511), said first front tibial supporting element being rigidly connected to said lateral malleolus supporting region and said plurality of individual flap-like front tibial supporting elements being rigidly connected to said medial malleolus supporting region, said first front tibial supporting element and said plurality of individual flap-like front tibial supporting elements having a lower degree of rigidity than said monolithic supporting framelike element.

10. Composite ski boot quarter according to claim 9, wherein said plurality of individual flap-like front tibial supporting elements comprise an upper pair of flap-like front tibial supporting elements (509 and 510) for overlapping said first front tibial supporting element, and a lower flap-like supporting element (511) for overlapping a ski boot shell (512) and for connection to said lateral malleolus supporting region, the quarter further comprising a rear strap-like element (513) which extends across said rear calf supporting element and which is connected between said lateral and medial malleolus supporting regions, said rear strap-like element having a rigidity similar to said rear calf supporting element.

11. Composite ski boot quarter according to claim 5, wherein said first supporting element is a monolithic supporting framelike element (602) comprising a lateral malleolus supporting region (603) and a medial malleolus supporting region (604), said lateral malleolus supporting region and said medial malleolus supporting region being arranged mutually opposite and being interconnected by a lower bridge region (605) overlying the user's heel region, said monolithic framelike element being provided with a substantially V-shaped gap (606) at the user's calf region above said lower bridge region, said first perimetric edge defining said V-shaped gap, said second supporting element being a rear calf supporting element (607) having a shape substantially equivalent to said V-shaped gap, the quarter further comprising a first front tibial supporting element (608) and a second front tibial supporting element (609), said first front tibial supporting element being rigidly connected to said lateral malleolus supporting region and said second front tibial supporting element being rigidly connected to said medial malleolus supporting region, said first and second front tibial supporting elements having a lower degree of rigidity than said monolithic supporting framelike element, said second front tibial supporting element being provided with flap elements (609*a* and 609*b*) for overlapping said first front tibial supporting element, said flap elements of said second front tibial supporting element being connectable to respective tab elements (603*a* and 603*b*) of said lateral malleolus supporting region.

* * * * *